United States Patent [19]

Yamamoto et al.

[11] Patent Number: 4,786,206

[45] Date of Patent: Nov. 22, 1988

[54] LINING TUNNEL WALL MADE BY SHIELD TYPE TUNNEL EXCAVATOR

[75] Inventors: Minoru Yamamoto; Fumitaka Kumai, both of Tokyo, Japan

[73] Assignees: Tekken Construction Co., Ltd.; Minoru Yamamoto, both of Japan

[21] Appl. No.: 48,605

[22] Filed: May 11, 1987

[30] Foreign Application Priority Data

Feb. 6, 1987 [JP] Japan ..... 61-26803

[51] Int. Cl.[4] ..... E21D 11/14

[52] U.S. Cl. ..... 405/146; 405/150; 405/141

[58] Field of Search ..... 405/146, 150, 138, 133, 405/141; 299/31, 32

[56] References Cited

U.S. PATENT DOCUMENTS

| | | | |
|---|---|---|---|
| 958,592 | 5/1910 | Butler | 405/146 |
| 2,148,783 | 2/1939 | Spaulding | 405/150 |
| 2,419,329 | 4/1947 | Wilson | 405/146 |
| 2,602,299 | 7/1952 | Sonderegger | 405/150 |
| 3,381,479 | 5/1968 | Curzio | 405/150 |
| 3,438,211 | 4/1969 | Zywietz et al. | 405/152 |
| 3,613,379 | 10/1971 | Jacobs | 405/146 X |
| 4,120,165 | 10/1978 | Stuckmann et al. | 405/146 X |
| 4,519,730 | 5/1985 | Horimatsu | 405/258 |
| 4,591,297 | 5/1986 | Horimatsu | 405/258 |
| 4,610,572 | 9/1986 | Horimatsu | 405/258 |

FOREIGN PATENT DOCUMENTS

| | | | |
|---|---|---|---|
| 0629346 | 9/1978 | U.S.S.R. | 405/146 |

*Primary Examiner*—Dennis L. Taylor
*Attorney, Agent, or Firm*—Leydig, Voit & Mayer

[57] ABSTRACT

A tunnel wall lining method is provided, wherein annular recesses circumferentially are provided in outer periphery of a lining form into which arcuate segments are assembled, a plurality of rows of reinforcing bars are arranged annularly in the respective recesses of the lining form, and a lining is constructed with concrete cast into a space between the tunnel wall and the lining form. The lining thus constructed includes circumferentially extending and radially inwardly projecting beams in which the reinforcing bars are embedded, whereby a lining having a reinforcing structure can be constructed in a simple and economical manner and in a shortened construction period.

10 Claims, 5 Drawing Sheets

LINING TUNNEL WALL MADE BY SHIELD TYPE TUNNEL EXCAVATOR

TECHNICAL BACKGROUND OF THE INVENTION

This invention relates to methods of lining the peripheral wall surface of a tunnel made by a shield type tunnel excavator. More particularly, it relates to a tunnel wall lining method which uses a unique lining form, in particular, during the construction of the lining against the tunnel wall, allowing the lining to be constructed without slowing the excavation speed of the shield type tunnel excavator.

A typical tunnel excavating method employes a shield type excavator. A steel-made cylindrical shield of the excavator is driven into the ground at the tunnel face and a rotary cutter head provided in the front portion of the excavator is rotated to excavate the ground. While excavating the tunnel with such shield type excavator, a lining must be formed against the peripheral wall of the bored tunnel, the lining extending behind the advancing excavator.

DISCLOSURE OF PRIOR ART

In constructing the lining against the tunnel wall surface, a plurality of arcuate reinforcing wall segments may be assembled into an annular configuration and installed as against the peripheral wall of the bored tunnel as a primary lining. Alternatively, may be cast against the peripheral wall of the bored tunnel to form the primary lining with a casting form annularly installed to face the peripheral wall. However, it has been often impossible to resist a high tunnel ground pressure only with such primary lining. For the purpose of effectively and safely resisting the tunnel ground pressure, a plurality of arcuate timbering members made of steel must be assembled into an annular configuration and installed with respect to the primary lining. A secondary lining having a better appearance is further provided over the primary lining to reinforce it.

In the method using the reinforcing wall segments, however, there has been a problem that the annular installation of many of the segments is rather complicated. This increases the necessary workers, working period and costs for the tunnel excavation. In addition, it has been almost impossible to bring the annularly assembled segments into close contact with the peripheral wall of the tunnel so that there is inevitably produced a gap between the segments and the peripheral wall. The gap requires a back filling with mortar or the like, rendering the formation of the lining even more complicated. On the other hand, the method of directly casting concrete against the peripheral wall of the tunnel with the casting form makes it possible to provide the primary lining in close relation to the peripheral tunnel wall in conformity to the advancing rate of the excavator as the casting form is installed annularly behind the advancing excavator. However, takes a relatively long time for the timbering member to be assembled after the setting of cast concrete, so that the assembling of the timbering members has had to be delayed relative to the construction of the primary lining. Accordingly, there have arisen such problems that the primary lining before installation of the timbering members cannot sufficiently resist the ground pressure so as to be low in the stability and thus in the safety, and that, so long as the advancing of the excavator as well as that construction of the primary lining are so performed as to conform to the required assembling time of the timbering members, the required tunnel construction period will have to be prolonged much.

TECHNICAL FIELD OF THE INVENTION

A primary object of the present invention is, therefore, to provide a method of lining tunnel wall made by a shield type tunnel excavator, which method can eliminate the foregoing problems in the prior art and can realize the construction of a lining in conformity with the rate of advance of the shield type tunnel excavator this simplifies the work required for lining the tunnel and to a large extent reduces the construction period, while utilizing the merits of direct concrete casting with respect to the peripheral tunnel wall.

According to the present invention, the above object is attained by a method of lining a peripheral tunnel wall made behind a shield type tunnel excavator as the excavator is advanced, which method comprises the step of assembling a plurality of arcuate segments into an annular lining form each segment having an arcuate recess for forming annular grooves in the outer periphery of the lining form when the segments are assembled. The method further comprises the steps of providing in the annular grooves a plurality of reinforcing bars, disposing the outer periphery of the lining form to oppose the peripheral tunnel wall, and casting a lining material into a space defined between the peripheral tunnel wall and the other periphery of the lining form to construct in the space a lining having annular beams circumferrentially extending and projecting radially inwardly, the beams having the reinforcing bars imbedded therein and acting as a reinforcing structure.

According to the tunnel wall lining method of the present invention arranged as above, the annular beams which have the reinforcing bars embedded therein and which project radially inwardly and extend circumferentially, are provided as the reinforcing structure simultaneously with the formation of the lining. This reinforcing structure has substantially the same reinforcing ability as the timbering employed in known lining methods. As a result, the lining can be structed in conformity the rate of advance of the shield type tunnel excavator in a simple manner, thus contributing to a remarkable reduction in the tunnel construction period and a decrease in the lining cost.

Other objects and advantages of the present invention shall be made clear in the following description of the invention detailed with reference to a preferred embodiment shown in accompanying drawings.

Figure 1:
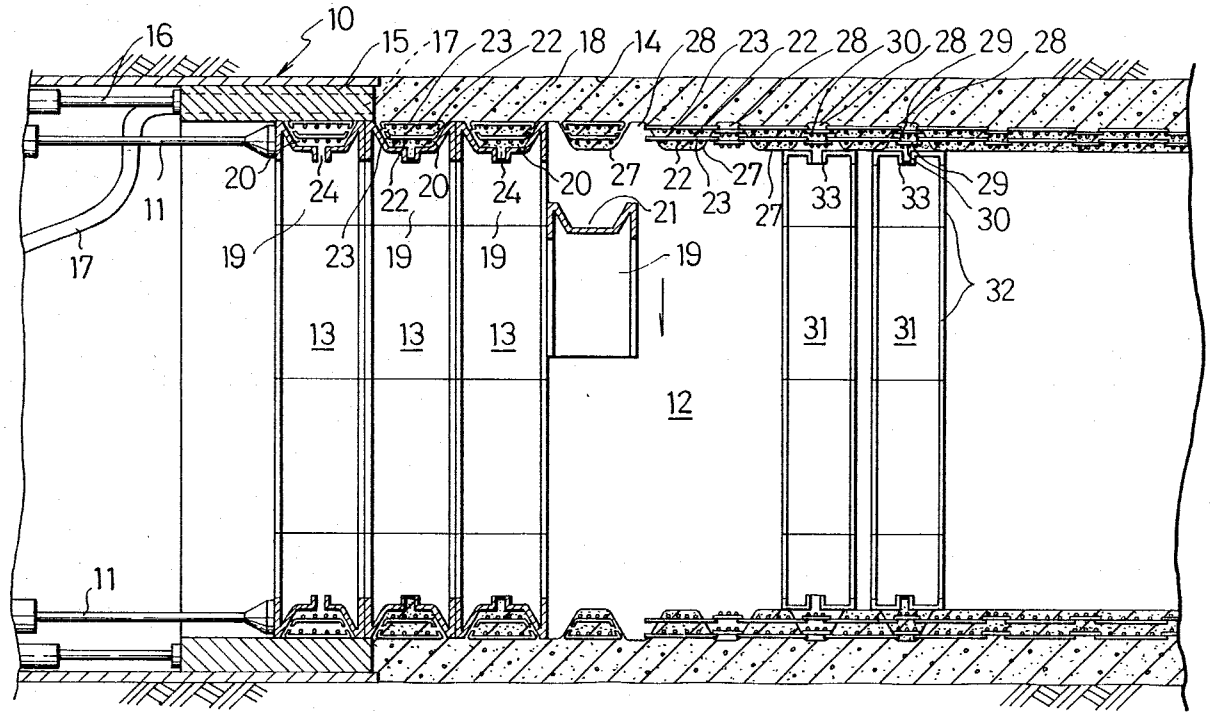
FIG. 1 is a schemetic sectional view of a tunnel including a tail section of a shield type tunnel excavator and forms for use in making a lining, showing a state in which the lining is continuously made against a peripheral tunnel wall excavated by the excavator, according to an embodiment of the tunnel lining method of the present invention.

While the present invention shall now be described with reference to the preferred embodiment shown in the drawings, it should be understood that the intention is not to limit the invention only to the particular embodiment shown, but rather to cover all alterations, modifications and equivalent arrangements possible within the scope of appended claims.

DISCLOSURE OF PREFERRED EMBODIMENT

Referring to FIG. 1, there is shown a tail section 10 of a cylindrical shield type tunnel excavator employed in an embodiment of the present invention. At a front part of the excavator, an excavating chamber (not shown) is defined by a bulkhead as has been well known. The excavating chamber includes a rotary cutter for the ground at the tunnel face, into which chamber, for example, a pressurized liquid is fed to prevent the tunnel face ground from collapsing and to allow the excavation to be smoothly performed. Mutually circumferentially spaced within the tail section 10 of the shield type excavator are a plurality of shield propelling jacks 11, plungers of which extend in the axially rearward direction of the excavator. The jacks 11 are fixedly mounted at their cylinder ends to the inner wall of the excavator and brought at their extended plunger ends into abutment with the foremost side end of a set of assembled segments of a lining form 13. The lining form 13 is installed in multiple stages sequentially behind the tail section of the excavator within an excavated tunnel 12. As the plungers of the jacks 11 are extended rearward following the excavation of the tunnel face ground by the rotary cutter, the excavator is caused to advance forwardly so as to extend the tunnel 12 in the propelled direction of the excavator.

Each set of the segments of the lining form 13 is installed on the rear side of the excavator in an annular shape and is spaced circumferentially from the peripheral wall surface 14 of the tunnel 12. A plurality of sets of the lining form segments are sequentially assembled into an annular shape at a position inside the tail section 10, as the excavator advances, so that at least the foremost part of the lining form 13 (in the illustrated embodiment, over the entire axial length of the foremost set of the lining form segments) will be overlapped with the tail section 10 as viewed radially outward from the longitudinal axis of the excavator. Disposed on the inner peripheral wall of the tail section 10 of the shield excavator is an annular end frame 15. The forward side end of the end frame 15 abuts against rearward extended plunger ends of a plurality of pressing jacks 16 for axial shifting of the end frame 15. Preferably, a plurality of concrete supply pipes 17 (only one of which is shown by dotted lines) are passed through the end frame 15 to cast such lining material as, preferably, concrete into a space defined between the outer periphery of the lining form 13 and the excavated tunnel wall surface 14. In the illustrated embodiment, the pressing jacks 16 are fixedly mounted within the excavator as mutually circumferentially spaced from one another. Their plungers extends in the axial direction of the excavator in similar manner to the propelled jacks 11 for pushing the end frame 15 against the pressure of the concrete being filled in the space between the lining form 13 and the tunnel wall surface 14. A dense primary lining 18 is thus provided in intimate contact with the tunnel wall surface 14.

Figure 2:
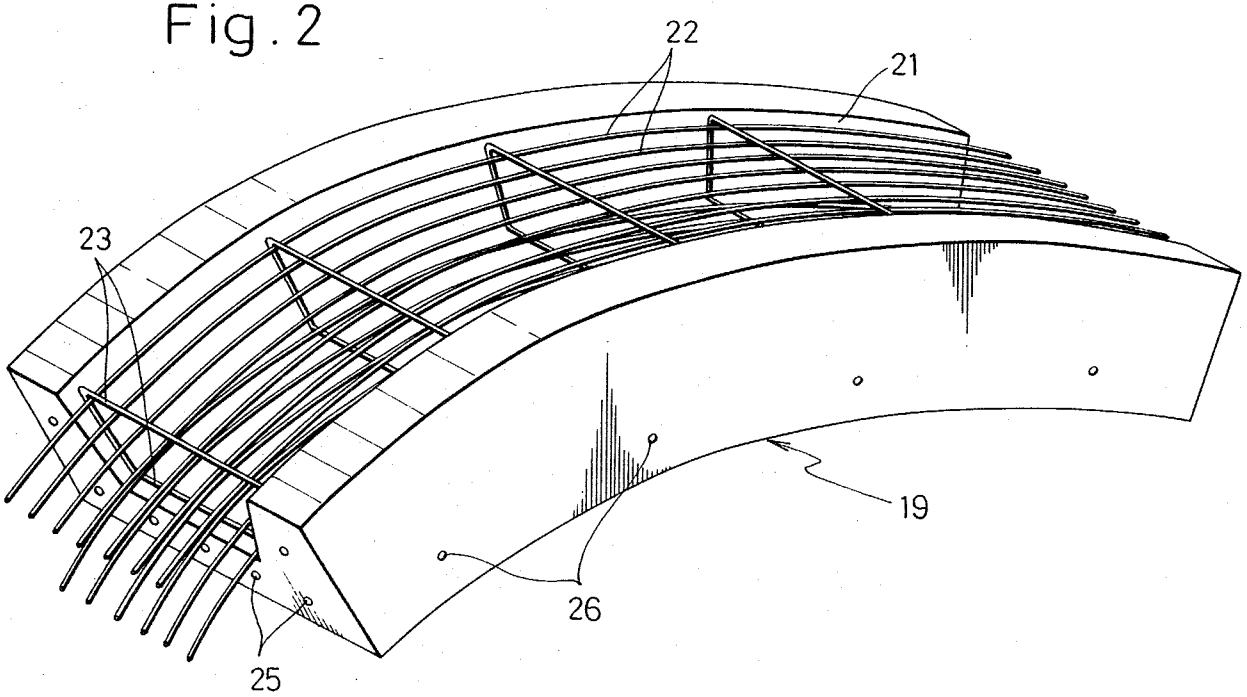
FIG. 2 is a magnified perspective view of a segment of the lining form used in the method of FIG. 1.
Figure 3:
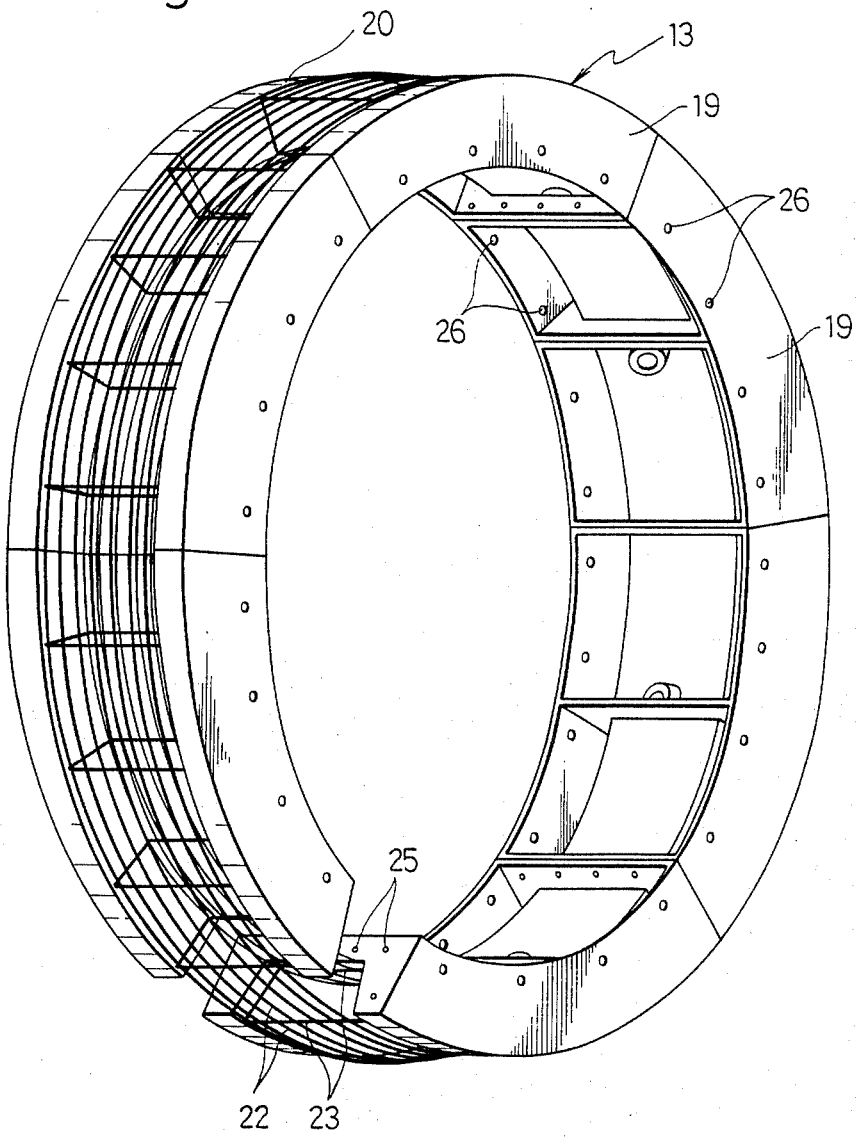
FIG. 3 is a perspective view of the lining form assembled in the lining method of FIG. 1.

Referring to FIGS. 2 and 3, the lining form 13, unique in the present invention, comprises a plurality of sets of arcuate segments 19 which are substantially M-shaped in section. A set of the segments 19 are assembled and joined to one another into an annular unit. Preferably, the segments 19 are respectively provided in their outer peripheral surface with a circumferential recess 21 generally V-shaped in section so that, when the annular unit of the segments 19 is assembled, a continuous annular groove 20 opened toward the peripheral tunnel wall surface 14 will be provided circumferentially about the annular unit. Disposed within the recess 21 of each segment are a plurality of arcuate reinforcing bars 22 of the same curvature as that of the arcuate segment 19. The bars 22 are located within the recess 21 and are spaced from one another in parallel relationship. The bars 22 are also slightly extended at least at one longitudinal end out of the recess 21 so that the bars 22 in the respective adjacent ones of the segments 19 may be joined in any suitable manner such as welding or the like in circumferential direction, when the segments 19 are assembled into the annular unit of the lining form 13. To secure the bars 22 spaced from one another within the recess 21 in each segment, they are coupled to a plurality of latitudinal reinforcing bars 23. The latitudinal reinforcing bars 23 are placed to transverse the circumferential direction so as to join the arcuate bars 22 in inner and outer two stages and thus generally into an annular cage, as shown in in FIGS. 1 to 3. Additional reinforcing bars may be arranged at an intermediate stage between the inner and outer stages whenever required and the latitudinal reinforcing bars may be replaced by radially extending reinforcing bars connecting the arcuate bars 22 of the two or three stages in depth direction of the recess 21. It is preferable that the latitudinally connecting bars 23 are bent at both ends to be directed inward within the groove 20 so that, when the arcuate reinforcing bars 22 in the cage shape are accommodated within the groove 20, the bent ends of the connecting bars 23 will abut against side walls of the groove 20. In this connection, it will be readily appreciated by those skilled in the art that the arcuate reinforcing bars 22 in the cage form can be secured in the groove 20 by any other proper fixing means that the bent ends of the latitudinal reinforcing bars 23.

More than one of the segments 19 of the lining form 13 is provided in the bottom of the recess 21 with a port 24 for casting concrete or the like lining material radially outward from the interior of the lining form 13 to the annular groove 20. The segment 19 is also formed to have in both end walls holes 25 through which such interlinking means as bolts may be passed to link circumferentially adjacent segments 19 with each other and to have in its latitudinal side walls holes 26 through which such interlinking means as bolts are passed to link adjacent annularly assembled sets of the lining forms 13 in the axial direction of the tunnel with one another. Circumferential size or length of the respective segments 19 may be variously prepared so as to be able to comply with any diameter of the tunnel. It may even be possible to combine the segments of different circumferential lengths to assemble them into an annular shape.

Figure 4:
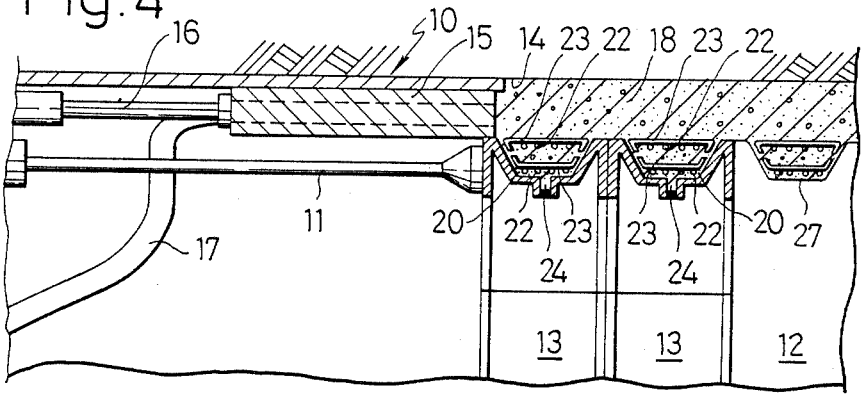
FIGS. 4 to 11 sequentially show steps of the lining method of FIG. 1.
Figure 5:
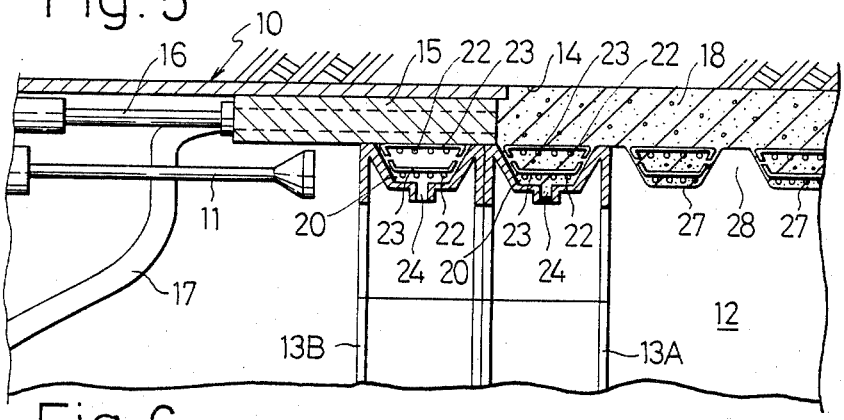
Figure 6:
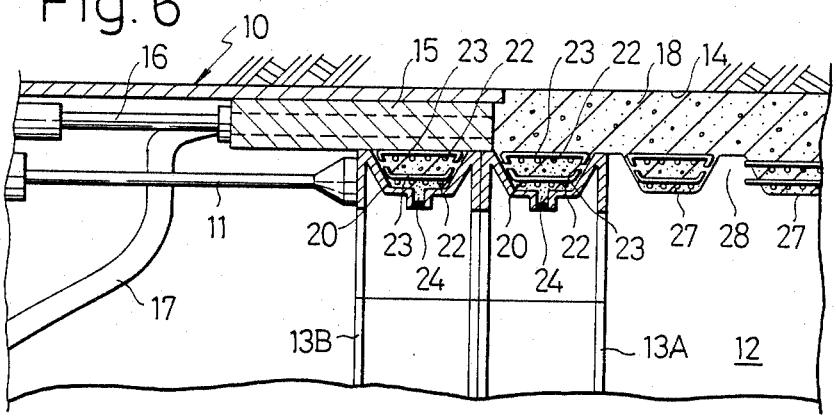
Figure 7:
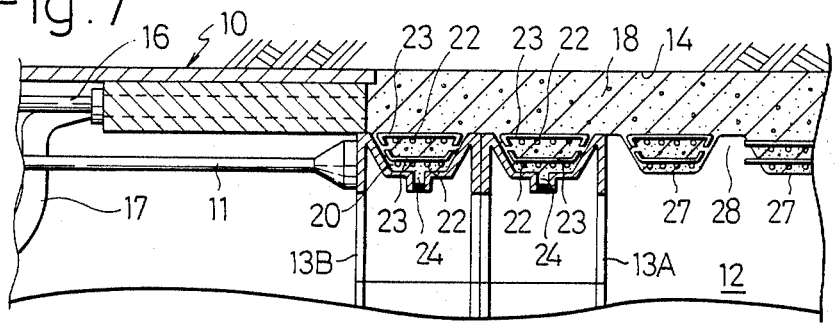
Figure 8:
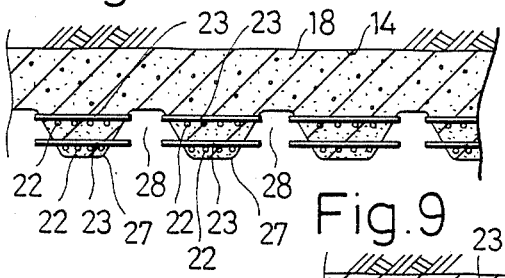
Figure 9:
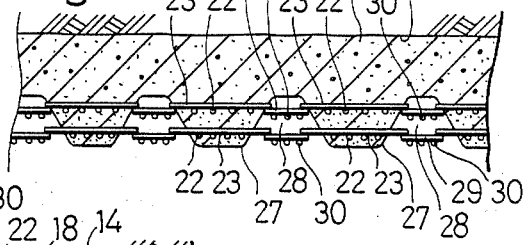
Figure 10:
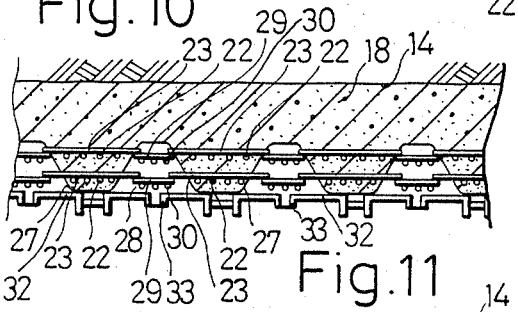

Referring next to steps of making the primary lining 18 with reference to FIGS. 4 to 7, the primary lining 18 is constructed sequentially by adding every new "pitch" component, which corresponds to the width of each set of assembled segments of the lining form 13 in the axial direction of the tunnel 12, to a previously constructed pitch component as shown in FIG. 4. First, as shown in FIG. 5, the propelling jacks 11 are retracted and a new set 13B of the lining form 13 is assembled adjacent the previously assembled set 13A of the lining form 13. The outer periphery of the new assembled set 13B with the annular groove 20 facing the tunnel wall surface 14, abuts against the inner periphery of the end frame 15. In this case, the adjacent sets 13A and 13B of the segments of the lining form 13 are coupled to each other by the interlinking means while the segments 19 of the new set 13B are mutually joined by the interlinking means into the annular shape, with the arcuate reinforcing bars 22 in the groove 20 of adjacent segments welded to each other into the annular shape. Subsequently, as shown in FIG. 6, such wall lining material as concrete preferably is cast through the port 24 into the groove 20 of the lining form 13, which is sealingly enclosed at the periphery by the end frame 15, until the groove is sufficiently filled with concrete, and then the port 24 is closed. Under this condition, the propelling jacks 11 are extended to come into abutment with the newly assembled set 13B of the lining form 13. The rotary cutter of the excavator is driven under a reaction force of the jacks 11 from the new and the foremost set 13B of the lining form segments, and the excavator is made to advance. During this advance of the excavator the end frame also advances. Concrete is cast through the pipe 17 to fill the space between the tunnel wall surface 14 and the new set 13B of the lining form 13. The cast concrete is then cured and allowed to set, as shown in FIG. 7. At this stage, the additional pitch component of the primary lining 18 is completed, and the respective steps described are repeated until the primary lining 18 is sequentially extended to a desired length in the tunnel.

Then, the lining form 13 is released from the primary lining 18 by disassembling the respective sets of the segments 19. As a result, the primary lining 18 having annular beams 27 projecting radially inward with intermittent annular recesses 28 formed between the respective beams 27 is exposed. Each beam 27 has a shape corresponding to that of the annular groove 20 of the lining form 13 and is reinforced by the rows of reinforcing bars 22 interlinked by the connecting bars 23 into the annular cage shape as embedded in the beam, to act as a reinforcing structure. The reinforcing bars of the annular cage shape embedded in the respective beams 27 provide for the primary lining 18 of the present invention substantially the same reinforcing function as a timbering applied to any known lining. In contrast to the known timbering, which has been particularly time-consuming during installation, the primary lining 18 per se can be provided with a high strength sufficient to resist the ground pressure applied to the tunnel 12 simultaneously with the construction of the primary lining 18. Thus it is possible to construct the primary lining directly after the advance of the excavator, and thus to shorten the required time for the tunnelling to a large extent.

Figure 11:
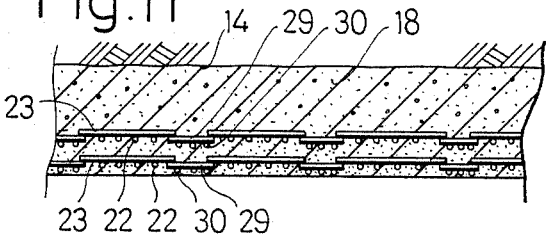

For the tunnel wall lining, the thus constructed primary lining 18 alone can provide a sufficient strength, but it is preferable to further construct over the primary lining 18 a secondary lining as shown in FIGS. 8 to 11 to provide increased strength and excellent apparance. In this case, as will be clear particularly from FIG. 8, the annular beams 27 of the primary lining 18 are slightly ground at, for example, side surfaces to expose both bent ends of the latitudinal connecting bars 23 and to straighten them to be parallel with the peripheral wall surface 14 of the tunnel 12. Next, as shown particularly in FIG. 9, opposing pairs of the exposed and straightened ends of the connecting bars 23 within the annular recesses 28 between the beams 27 are connected to each other by means of connecting bars 29 by welding or the like, and further arcuate reinforcing bars 30 are coupled by welding or the like to the connecting bars 29. The reinforcing bars 30 extend circumferentially within the respective annular recesses 28. In this case, the connecting bars 29 and arcuate reinforcing bars 30 may be preliminarily welded together into cages which are accommodated in the arcuate recess 28. Both ends of the connecting bars 29 may then be connected to the opposing ends of the connecting bars 23 exposed from the beams 27. Then, as shown particularly in FIGS. 1 and 10, arcuate segments 32 of a lining form 31 for the secondary lining are assembled against the primary lining 18 across the respective adjacent beams 27 to close the annular recesses 28. A plurality of the arcuate segments 32 are also assembled into annular shape, while more than one of the segments 32 are provided with a port 33 through which such lining material as, preferably, concrete is cast radially outward into the recess 28 between the respective beams, as in the case of the lining form 13. When the recesses 28 are thus sufficiently filled with concrete, the ports 33 are closed, and the lining form segments 32 are disassembled when the cast concrete has been cured and allowed to set. The secondary lining can thus be constructed between the respective annular beams 27. Since the arcuate reinforcing bars 30 and connecting reinforcing bars 29 are also embedded in the secondary lining, it will be understood that, when the secondary lining is constructed directly after the advance of the excavator as in the case of the primary lining, a strong composite lining comprising the primary and secondary linings can be constructed on the peripheral wall surface 14 of the tunnel 12, extending behind the tail section 10 of the excavator, as shown in FIGS. 1 and 11. The composite lining not only has sufficient strength due to the composite reinforcing bars embedded therein and also has a substantially smooth peripheral wall surface.

The present invetion may be modified in various ways. For example, the reinforcing bars accommodated in the grooves 20 and recesses 28 have been disclosed to be interlinked preferably into a cage shape. Alternatively they may be interlinked relatively more densely in a grid form as viewed from a direction normal to the circumferential direction. Further, although the lining form 31 for the secondary lining has been referred to as being provided across the adjacent ones of the annular beams 27 of the primary lining 18, the form 31 may be provided as slightly spaced radially inward from the inner periphery of the beams 27. The resulting secondary lining will thus extend relatively thinly over the inner periphery of the beams 27. Further, the lining form 13 may not be provided with concrete casting ports 24, since it is possible to have concrete for filling the space between the tunnel wall surface 14 and the lining form 13 also cast simultaneously into the annular grooves 20 of the lining form 13. In addition, although the lining form 13 has been disclosed to be substantially M-shaped in section so as to have the annular groove 20, any other sectional shape may be employed so long as the lining form 13 is provided on its outer peripheral side with annular grooves. While the both ends of latitudinal connecting reinforcing bars 23 have been disclosed as being bent and later straightened to extend from the annular beams 27 in the primary lining 18, it may be possible to eliminate the straightening step with respect to the bent ends of the connecting bars 23 by providing to the form 13 itself a recessed means for accommodating both ends of the connecting reinforcing bars 23 extended straight.

What is claimed as our invention is:

1. A method of lining a periperhal tunnel wall made behind a shield type tunnel excavator as said excavator is advanced, the method comprising the steps of assembling a plurality of arcuate segments into an annular lining form, each segment having an arcuate recess for forming annular grooves in the outer periphery of the lining form when said segments are assembled, providing in said annular grooves a plurality of reinforcing bars, disposing said outer periphery having said annular grooves of said lining form to oppose said peripheral tunnel wall, and casting a lining material into a space defined between said peripheral tunnel wall and said outer periphery of the lining form to construct in said space a lining having annular beams circumferentially extending and projecting radially inwardly, said beams having said reinforcing bars embedded therein and acting as reinforcing structure.

2. A method according to claim 1 wherein said lining having said annular beams is constructed as a primary lining and whenin the method further comprises a step of making a secondary lining on said primary lining by casting said lining material at least into annular recesses defined between said annular beams.

3. A method according to claim 2 wherein said step of making said secondary lining includes convering the inner periphery of said annular beams with said lining material.

4. A method according to claim 2, wherein said arcuate segments are substantially M-shaped in section and have means for casting said lining material radially outward into said grooves, wherein said segment assembling step comprises further steps of positioning said lining form to overlap with a tail section of said shield type tunnel excavator and fitting a shiftable end frame between said tail section and said lining form, and wherein said lining-material casting step for constructing said primary lining comprises further steps of casting through said radially outward casting means of the segments the lining material into said annular grooves of the lining form with said end frame fitted in a position to close the grooves, shifting the end frame from said position of closing the grooves following said advance of said excavator, and casting the lining material into a space defined between said peripheral tunnel wall and said lining form.

5. A method according to claim 4 wherein providing said reinforcing bars includes arranging circumferential arcuate bars in top and bottom parts of the respective grooves and linking said top and bottom arcuate bars with connecting bars in a direction transverse to the arcuate bars to form a cage.

6. A method according to claim 5 further comprising, prior to said step of making said secondary lining, a step of exposing both ends of said connecting bars embedded in said beams and extending the ends parallel to the tunnel wall.

7. A method according to claim 6 wherein said step of making said secondary lining includes further steps of providing a plurality of arcuate reinforcing bars linked to said exposed ends of said connecting bars in said annular recesses defined between adjacent beams, disposing against said annular recess a further lining form for forming said secondary lining, said further lining form comprising segments having means for casing said lining material radially outward into said annular recesses, and casting said lining material into the annular recesses through said casting means.

8. A method according to claim 7 wherein said reinforcing bars provided in said annular recesses between said annular beams of said primary lining include further connecting bars linked to said exposed ends of said connecting bars embedded in the beams and further arcuate bars linked to said further connecting bars to form circumferentially extending annular cage.

9. A method according to claim 1 wherein providing a plurality of annular reinforcing bars includes providing said bars while assembling said arcuate segments into said lining form.

10. A method according to claim 9, wherin providing said annular reinforcing bars while assembling said arcuate segments includes joining arcuate segments of reinforcing bars respectively disposed in said arcuate recess of each arcuate segment.

* * * * *